US006669442B2

(12) United States Patent
Jinnai et al.

(10) Patent No.: US 6,669,442 B2
(45) Date of Patent: Dec. 30, 2003

(54) METHOD AND DEVICE FOR ASSEMBLING AND ADJUSTING VARIABLE CAPACITY TURBINE

(75) Inventors: Yasuaki Jinnai, Kanagawa-ken (JP); Takashi Mikogami, Kanagawa-ken (JP); Koji Matsumoto, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/086,450

(22) Filed: Mar. 4, 2002

(65) Prior Publication Data

US 2003/0077167 A1 Apr. 24, 2003

(30) Foreign Application Priority Data

Mar. 2, 2001 (JP) ..... 2001-057834

(51) Int. Cl.[7] ..... F01D 17/16
(52) U.S. Cl. ..... 415/160; 29/889.2
(58) Field of Search ..... 415/160, 165, 415/163; 29/889.2

(56) References Cited

U.S. PATENT DOCUMENTS 2,860,827 A * 11/1958 Egli ..... 415/164
4,836,747 A * 6/1989 Hotz ..... 415/163
5,518,365 A * 5/1996 Baets et al. ..... 415/160
5,851,104 A * 12/1998 Dakin et al. ..... 415/150
6,471,470 B2 * 10/2002 Yoshimura et al. ..... 415/160

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

The invention provides a method and device of assembling and adjusting a variable capacity turbine, which simplifies assembling process resulting in reduction of man-hours and costs of assembling and adjustment, and makes it possible that the nozzle vane setting of the adjustable nozzle mechanism is done with high accuracy without influenced by the accuracy in dimensions of the constituent parts such as nozzle vane and annular link mechanism and that the adjustable nozzle vane mechanism is adjusted whenever necessary even after the turbine is assembled.

The invention is characterized in that a plurality of nozzle vanes are temporarily encircled and bound with a binding member capable of binding/releasing such as belt, etc. in a state the vanes are perfectly closed with the vanes contacting to each other, then the nozzle pin fixed to each of the nozzle vanes and supported free of rotation in the nozzle mount is fixed by staking or the like to the lever plate constituting the connection part of the annular link mechanism with the vanes in the temporarily bound state.

8 Claims, 7 Drawing Sheets

METHOD AND DEVICE FOR ASSEMBLING AND ADJUSTING VARIABLE CAPACITY TURBINE

BACKGROUND OF THE INVENTION

1. Field of the Invention

The present invention relates to a method and device for assembling and adjusting the adjustable nozzle mechanism of a radial flow turbine used as the supercharger of an internal combustion engine (exhaust turbocharger) and so forth, the turbine being configured so that the actuating gas flows from the spiral scroll formed in the turbine casing to the turbine rotor in the radial direction via a plurality of nozzle vanes of variable wing angle to rotate the turbine rotor.

2. Description of the Related Art

In order to make a good match of the exhaust gas flow rate of the engine with that with which the supercharger operates in the optimum operation condition, superchargers equipped with variable capacity turbines capable of changing the exhaust gas flow rate in accordance with the operating condition of the engines, have been in wide spread use in recent years in internal combustion engines with superchargers.

A supercharger with such a variable capacity turbine is equipped with an adjustable nozzle mechanism in order to change the turbine capacity. The adjustable nozzle mechanism can change the wing angle of the nozzle vanes through rotating the nozzle vanes by means of an annular link mechanism (ring assembly) which is driven to rotate around the rotation center of the turbine rotor by an actuator by way of an actuator rod.

For a method to achieve assembling and adjustment of such an adjustable nozzle mechanism, an invention of Japanese Patent No. 3,085,210 has been proposed.

In the concerned invention, a jig should be placed in the inner radius of the nozzle vane to perform the setup for perfect closing of the nozzle vane and the ring assembly to be driven for rotations around the turbine rotor shaft. The jig therein can be put in contact with the rear edge of the nozzle vane, wherein the stopper pin is mounted after the nozzle vane and the lever plates are welded together upon putting the nozzle vane in contact with the jig in the state that the stopper pin, that is to be fitted into the long slots located at multiple positions along the circumferential direction of the link plate, is made non-functional or non-existing, and upon fitting the matching pin into the phase matching hole to finalize the entire ring assembly in the perfect closing phase.

However, according to the invention of Japanese Patent No. 3,085,210, the two different processes are required, one of which is to put the jig in contact with the nozzle vane in the nozzle vane-free state wherein the stopper pin to be fitted into the long slots of the link plate is non-functional, and the other process is, keeping the above state, to engage the phase matching hole and the phase matching pin, and set the entire ring assembly in the perfect closing phase, then weld the nozzle vane and the lever plate, and fix the stopper pin. This makes assembly and adjustment work of the adjustable nozzle mechanism troublesome, requiring a lot of man-hours resulting in increased costs.

According to the conventional art, the setup for perfect closing of the adjustable nozzle mechanism is done by fitting each stopper pin into each long slot provided on the link plate along the circumferential direction and matching the contact angle with the lever plate by contacting the tail end of the nozzle bane with the jig, so variations in setup for perfect closing tend to occur resulting in setup error. Moreover, as the perfect closing position of the adjustable nozzle mechanism is influenced by the accuracy of such constituent parts as described above, the adjustment is difficult after assembling turbine.

SUMMARY OF THE INVENTION

In consideration of the problems with the conventional art mentioned above, the object of this invention is to provide a method and device for assembling and adjusting a variable capacity turbine, which simplifies the assembling and adjustment process of an adjustable nozzle mechanism to reduce man-hours and costs for assembling and adjustment, is capable of setting up the positions of the nozzle vanes of an adjustable nozzle mechanism with good accuracy without influenced by the accuracy in dimension of the constituent parts such as nozzle vanes, annular link assemblies (ring assembly), etc., and is capable of adjusting the adjustable nozzle mechanism whenever necessary even after they are assembled.

In order to solve the concerned problems, the invention proposes a method of assembling and adjusting a variable capacity turbine having a plurality of nozzle vanes disposed along the circumferential direction of a turbine rotor in the inner radius side of the spiral scroll formed in the turbine casing and supported free of rotation on the supporting part of the nozzle mount, the turbine rotor being supported in the turbine casing for rotation around the rotation axis; and an annular link mechanism mounted free of rotation with respect to the rotation axis, provided with connection parts each of which is connected with the driving part of each of said nozzle vanes, and connected with the output end of an actuator; characterized in that said plurality of the nozzle vanes are temporarily encircled and bound with a binding member capable of binding/releasing such as belt, etc. in a state the vanes are perfectly closed with the vanes contacting to each other, then the driving part of each nozzle vane is fixed to the connection parts of the annular link mechanism with the vanes in the temporarily bound state.

It is preferable that the nozzle pins each of which is fixed to each of the nozzle vanes and supported in said nozzle mount free of rotation are fixed to lever plates constituting the connection parts of the annular link mechanism by means of staking or the like in the temporarily bound state with the vanes perfectly closed.

It is also preferable that the constituent parts can be transferred or installed into the turbine in the state of a nozzle assembly temporarily fixed to the supporting part of said nozzle mount by encircling and binding with a binding member capable of binding/releasing such as belt, etc. in a state the vanes are perfectly closed with the vanes contacting to each other.

The invention is also characterized in that a nozzle vane side mating part is provided in the nozzle mount, a link side mating part is provided in the annular link mechanism, a jig is prepared of which at an end side is formed a portion for determining the nozzle vane side position and at the other end side is formed a portion for determining the annular link mechanism side position, said portion for determining the nozzle vane side position of said jig is mated with said nozzle vane side mating part of said nozzle mount and said link side mating part is mated with said portion for determining the annular link mechanism side position with each nozzle vane temporarily fixed in perfect closing position, and the perfect closing position of the nozzle vane side and the annular link mechanism side is set up by way of the nozzle vane combining part of said nozzle mount by fixing said nozzle pins to said lever plate by staking or the like.

It is preferable that said nozzle mount is provided with a mating hole as said nozzle vane side mating part, said jig is provided with a pin-like protrusion as said portion for determining the nozzle vane side position and a contact face capable of contacting with a face of the link plate constituting said annular link mechanism as said portion for determining the annular link mechanism side position, and positioning is done by allowing said face of the link plate to contact with said contact face of said jig in the state said protrusion of said jig is inserted in said mating hole of said nozzle mount.

It is also preferable that said nozzle mount is provided with a mating hole as said nozzle vane side mating part, said jig is provided with a pin-like protrusion as said portion for determining the nozzle vane side position and a groove capable of meshing with the connection pin of the link plate constituting said annular link mechanism as said portion for determining the annular link mechanism side position, and positioning is done by allowing said connection pin of the link plate to mesh with said groove of said jig in the state said protrusion of said jig is inserted in said mating hole of said nozzle mount.

The invention proposes a device for assembling and adjusting a variable capacity turbine having a plurality of nozzle vanes disposed along the circumferential direction of a turbine rotor in the inner radius side of the spiral scroll formed in the turbine casing and supported free of rotation on the supporting part of the nozzle mount, the turbine rotor being supported in the turbine casing for rotation around the rotation axis; and an annular link mechanism mounted free of rotation with respect to the rotation axis, provided with connection parts each of which is connected with the driving part of each of said nozzle vanes, and connected with the output end of an actuator; characterized in that a binding member is provided which encircles and binds said plurality of the nozzle vanes to fix them in perfect closing position with the vanes contacting to each other, said binding member being capable of binding/releasing, and a minimum stopper is provided for limiting the shift of the linkage connecting said actuator and annular link mechanism toward perfect closing side.

It is preferable that a maximum stopper is provided for limiting the shift of the linkage toward full open side.

According to the present invention, a plurality of nozzle vanes are encircled with a binding member capable of binding/releasing to temporarily fix the vanes in a state the vanes are perfectly closed with the vanes contacting to each other; then the positioning of the nozzle vane side, i.e. the nozzle assembly side relative to the annular link mechanism side, is performed by use of jigs in the temporally fixed state; and the driving part of each nozzle vane is fixed to each connection part of the annular link mechanism; so adjustment of the perfect closing position is unnecessary in nozzle assembling process, and the adjustment of perfect closing position is possible by means of a minimum stopper in the assembled state of the variable capacity turbine.

The adjustable nozzle mechanism is set by this simple method, in which a plurality of the nozzle vanes are bound by an encircling binding member, the relative position of the nozzle vane side to the annular link mechanism side is determined by use of jigs, and each nozzle vane is fixed to each lever plate, which eliminates the necessity of adjustment of perfect closing position in the assembling of the nozzle vanes, the assembling and adjustment procedure is extremely simplified compared with the prior art disclosed on Japanese Patent No. 3085210 in which the adjustment of perfect closing position is done in the assembling process of nozzle vanes by use of a plurality of long slots in the link plate, stopper pins, and a jig. Therefore, man-hours for assembling and adjustment decreases and accordingly manufacturing costs is reduced.

According to the present invention, a plurality of nozzle vanes are bound by encircling them with a binding member to determine perfect closing position, each nozzle vane is fixed to the lever plate 2, and the adjustment of perfect closing position is done as a whole by a minimum stopper in the assembled state of the variable capacity turbine, so errors in dimensions of the nozzle side assembly including nozzle vanes and annular link mechanism side assembly including link plate and linking parts in assembled state can be absorbed. Therefore, the setting of the adjustable nozzle mechanism is possible with good accuracy without influenced by the accuracy in dimensions of the constituent parts and without influenced by the accuracy in dimensions of the nozzle side assembly and annular link mechanism side assembly, contrary to the case of the prior art disclosed on Japanese Patent No. 3085210 whereby variation in the setting of perfect closing position of each nozzle vane occurs because the adjustment of perfect closing position is done in nozzle vane assembling process by use of a plurality of long slots in the link plate, stopper pins, and a jig, which results in a setting error. The adjustable nozzle mechanism with high accuracy of setting according to the invention is adaptable to various specifications.

It is also possible that the variable capacity turbine according to the invention has the same function as the exhaust brake of truck and so forth by adjusting the perfect closing position by the minimum stopper as desired. The adjustment of the full open position of the nozzle vanes is possible by the maximum stopper in the assembled state of the variable capacity turbine.

Further, according to the invention, the adjustable nozzle mechanism assembly can be transferred and installed into the turbine in the state in which a plurality of the nozzle vanes are temporarily encircled and bound with the binding member and fixed to the supporting parts of the nozzle mount 4, damage to the constituent parts of the nozzle assembly due to vibration or impact is prevented.

BRIEF DESCRIPTION OF THE DRAWINGS

FIG. 4(A) is a view in the direction of arrow B of FIG. 1, and FIG. 4(B) is a view in the direction of arrow D of FIG. 4(A).

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not to limit the scope of the present invention.

Figure 1:
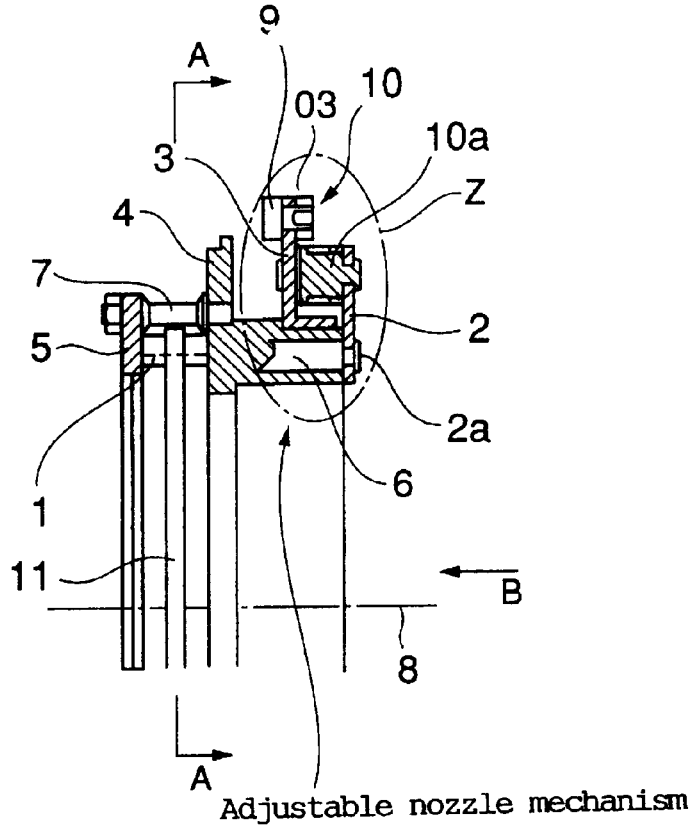
FIG. 1 is a longitudinal partial sectional view showing the adjustable nozzle mechanism of the supercharger with a variable capacity turbine.
Figure 2:
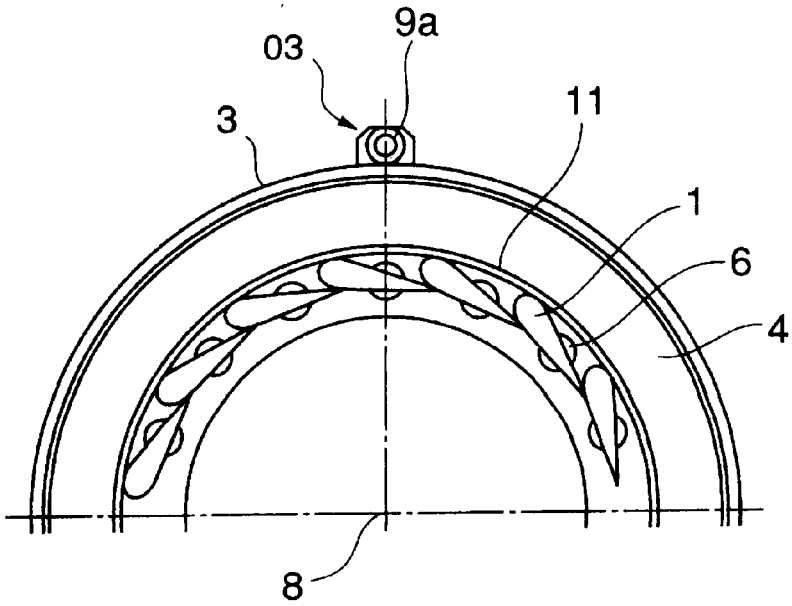
FIG. 2 is a sectional view along line A—A of FIG. 1.
Figure 3:
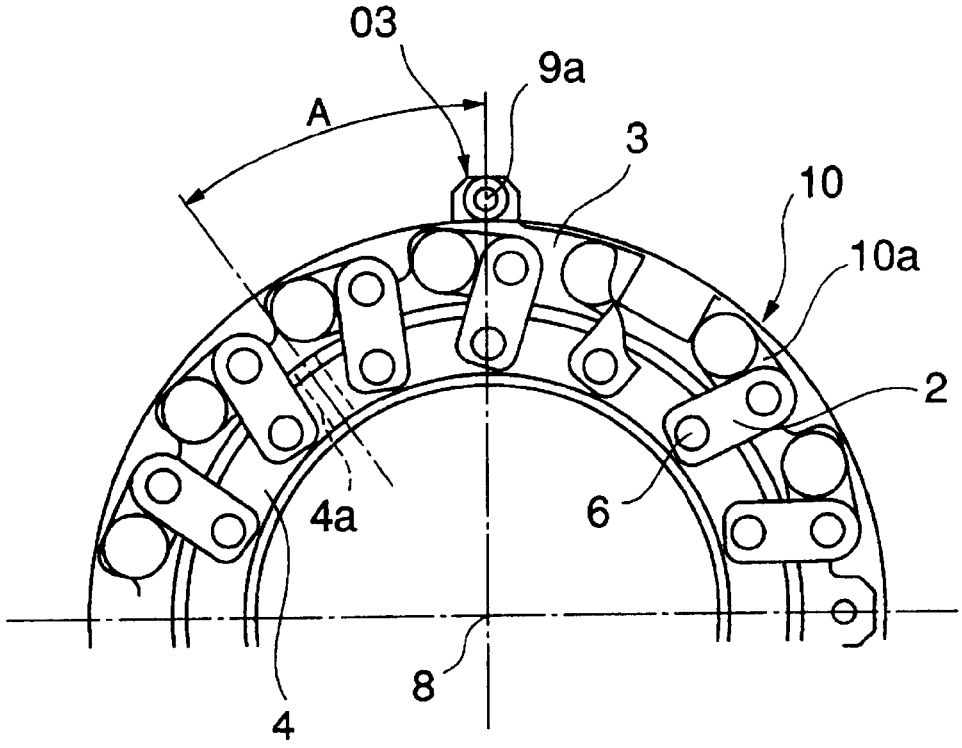
FIG. 3 is a view in the direction of arrow B of FIG. 1.
Figure 6:
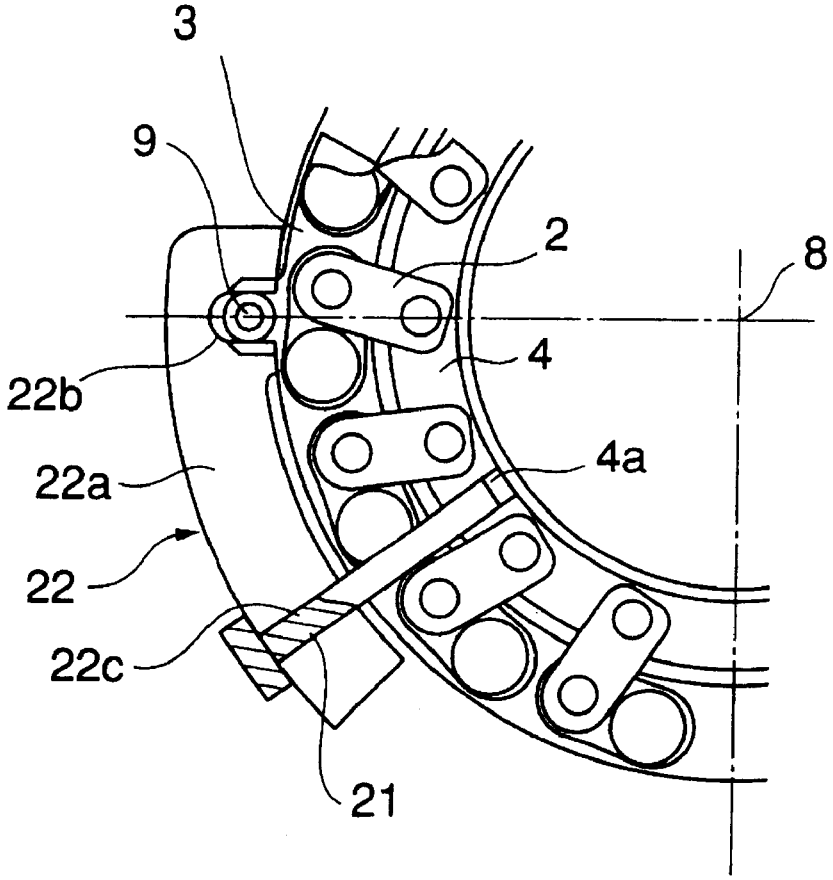
FIG. 6 represents the second example of the method of assembling and adjusting the adjustable nozzle mechanism and shows a view in the direction of arrow B of FIG. 1.
Figure 7:
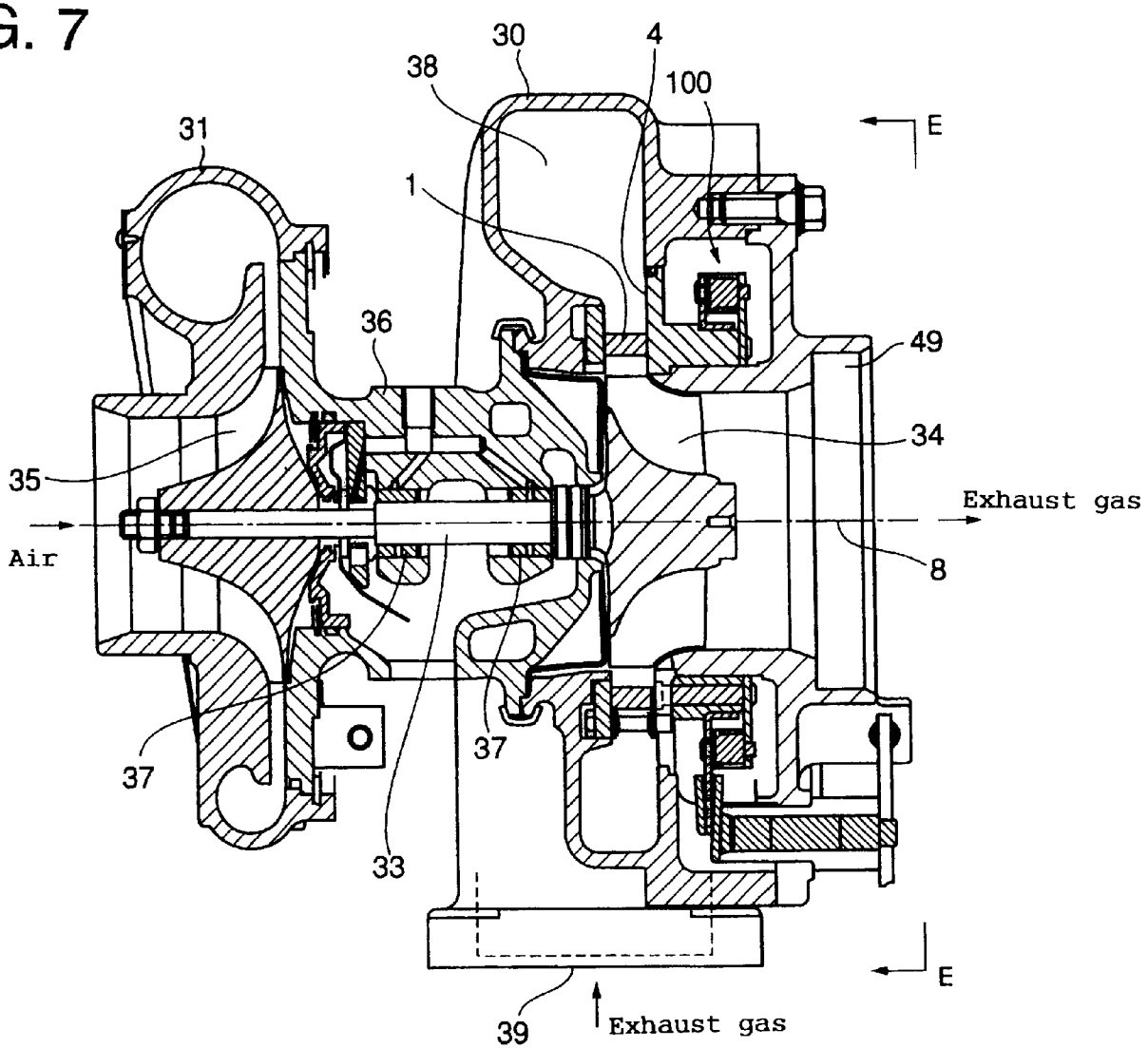
FIG. 7 is a longitudinal sectional view of the supercharger with a variable capacity turbine to which the present invention is applied.
Figure 8:
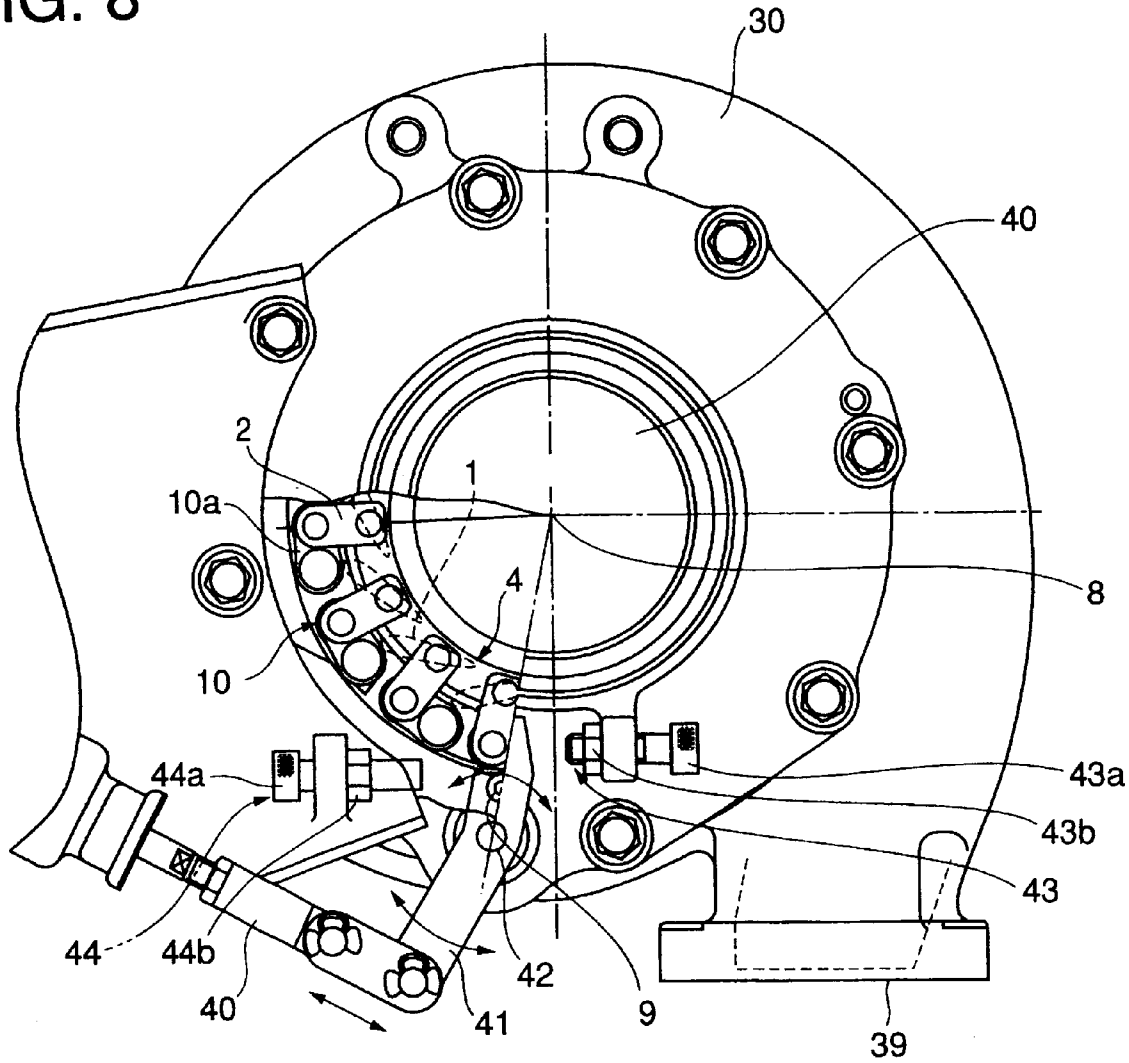
FIG. 8 is a view in the direction of arrows E—E of FIG. 7.

FIG. 1 is a longitudinal partial sectional view showing the adjustable nozzle mechanism of the supercharger with a variable capacity turbine, FIG. 2 is a sectional view along line A—A of FIG. 1, FIG. 3 is a view in the direction of arrow B of FIG. 1. FIG. 4(A) and FIG. 4(B) represent the first example of the method of assembling and adjusting the adjustable nozzle mechanism; FIG. 4(A) is a view in the direction of arrow B of FIG. 1, and FIG. 4(B) is a view in the direction of arrow D of FIG. 4(A). FIG. 5 is a view in the direction C of FIG. 4(A). FIG. 6 represents the second example of the method of assembling and adjusting the adjustable nozzle mechanism and shows a view in the direction of arrow B of FIG. 1. FIG. 7 is a longitudinal sectional view of the supercharger with a variable capacity turbine to which the present invention is applied. FIG. 8 is a view in the direction of arrows E—E of FIG. 7.

In FIG. 7 showing the structure of the supercharger with variable capacity turbine to which the present invention is applied, reference number 30 is a turbine casing, 38 is a scroll passage formed in spiral around the circumference section in the turbine casing 30, 39 is an exhaust inlet to the scroll passage 38, 49 is an exhaust gas outlet for letting out the exhaust gas having done expansion work in the turbine wheel 34. Reference number 31 is a compressor casing, 36 is a bearing housing which connects the compressor casing 31 with the turbine casing 30. Reference number 34 is a turbine wheel, 35 is a compressor wheel, 33 is a turbine rotor shaft connecting the compressor wheel 35 to the turbine wheel 34, 37 are bearings provided in the bearing housing 36 for supporting the turbine rotor shaft 33.

Reference number 1 are nozzle vanes which are positioned around the circumferential inlet of the turbine wheel 34 in the inner side of the scroll passage 38 spaced at regular intervals. The nozzle pins (see FIG. 1) formed integral with the nozzle vanes are supported free of rotation in a nozzle mount 4 fixed to the turbine casing 30, and thus the wing angle of the nozzle vanes is able to be changed.

Reference number 100 is an adjustable nozzle mechanism. An actuator drives an actuator rod 40 (see FIG. 8) to rotate a ring assembly 10 (annular link mechanism, see FIG. 1) around the rotation axis of the turbine rotor shaft 33. The nozzle vanes are rotated by the rotation of the ring assembly 10 to be changed in its wing angle.

With this construction of the supercharger with variable capacity turbine, the exhaust gas from an internal combustion engine (not shown) enters into the scroll passage 38 and flows in the nozzle vanes 1 circling along the spiral of the scroll passage 38. The exhaust gas flows through the wing space between the nozzle vanes, enters into the turbine wheel 34 from the outer circumference thereof, flows in the radial inward direction expanding while executing work to the turbine wheel 34, and exits from the exhaust outlet 49 in the longitudinal direction.

According to the present invention, the means of assembling and adjusting the adjustable nozzle mechanism of the variable capacity turbine is improved as described hereinafter.

In FIGS. 1~3 and FIG. 8, reference number 10 is a ring assembly comprising a link plate 3 of disk like shape and lever plates 2 connected with the link plate 3 by means of link parts 10*a*. The same number of the link parts 10*a* and lever plates 2 as that of the nozzle vanes 1 are provided, each corresponding to each nozzle vane, spaced at regular circular interval as shown in FIG. 3.

Reference number 03 is a connection part of the link plate 3. As shown in FIG. 8, a drive lever 41 which is connected to an actuator rod 40 is connected to the connection part 03 by means of a connection pin 9 fitted to the connection part.

Reference number 4 is an annular shape nozzle mount fixed to the turbine casing 30, 5 is a disk like nozzle plate. A number of nozzle supports 7 are provided along the circumferential direction to fix the nozzle plate 5 to the nozzle mount 4.

The nozzle vanes 1 are disposed inside the nozzle support between the nozzle mount 4 and nozzle plate 5. Nozzle pins 6 fixed to the nozzle vanes (or integral with the nozzle vanes) are supported free of rotation by the nozzle mount 4. Each nozzle pin 6 fixed to each nozzle vane is fixed to the lever plate 2 at the lower end part thereof by staking at its end part as indicated by reference number 2*a*.

In FIG. 8, the drive lever 41 is supported by the turbine casing 30 at its center part by the support shaft 42. An end part of the drive lever 41 is connected to the connection part 03 of the link plate 3 by means of the connection pin 9, and the other end is connected to the actuator rod 40 extending from an actuator not shown in the drawing.

The drive lever 41 swings around the support shaft 42 according to the reciprocating motion of the actuator rod 40, and the link plate 3 is driven to rotates around the rotation axis 8 of the turbine by means of the connection part 03 of the link plate 3 to which the drive lever 41 is connected.

As the lever plate 2 swings according to the rotation of the link plate 3 by means of the link parts 10*a*, the nozzle pins 6 fixed by staking to the lever plates 2 at the lower end parts thereof rotates, and the nozzle vanes 1 integral with the nozzle pins 6 rotates, as can be understand from FIG. 3 and FIG. 8.

The reciprocating movement of the actuator rod 40 and the swing movement of the nozzle vanes are the same as those of the ordinary variable capacity turbines.

Next, the method of assembling and adjusting the adjustable nozzle mechanism 100 of the variable capacity turbine equipped with the adjustable nozzle mechanism 100 of the construction described above will be explained.

At first, the plurality of the nozzle vanes 1 are disposed to contact to each other to be in a perfectly closed state and encircled with a belt 11 to be temporarily bound. By this, a number of the nozzle vanes 1 are all set to the perfectly closed state. The member for binding the nozzle vanes 1 is not limited to be the belt 11, a string, a rubber member, and the like may be usable as far as it is easy to bind and release the vanes.

The ring assembly 10 is prepared beforehand by fitting an end side of each of the link parts 10*a* free of rotation to the link plate 3 and further fitting the upper end part of each of the lever plate 2 free of rotation to the other end of each of the link parts 10*a*.

Each of the nozzle vanes 1 is fitted between the nozzle mount 4 and nozzle plate 5, the nozzle mount 4 and nozzle plate 5 are positioned and fixed to the nozzle supports 7 by the conventional method.

Then, the position of the ring assembly 10 corresponding to perfect closing position of the nozzle vanes is determined by one of the following two methods.

Figure 4:
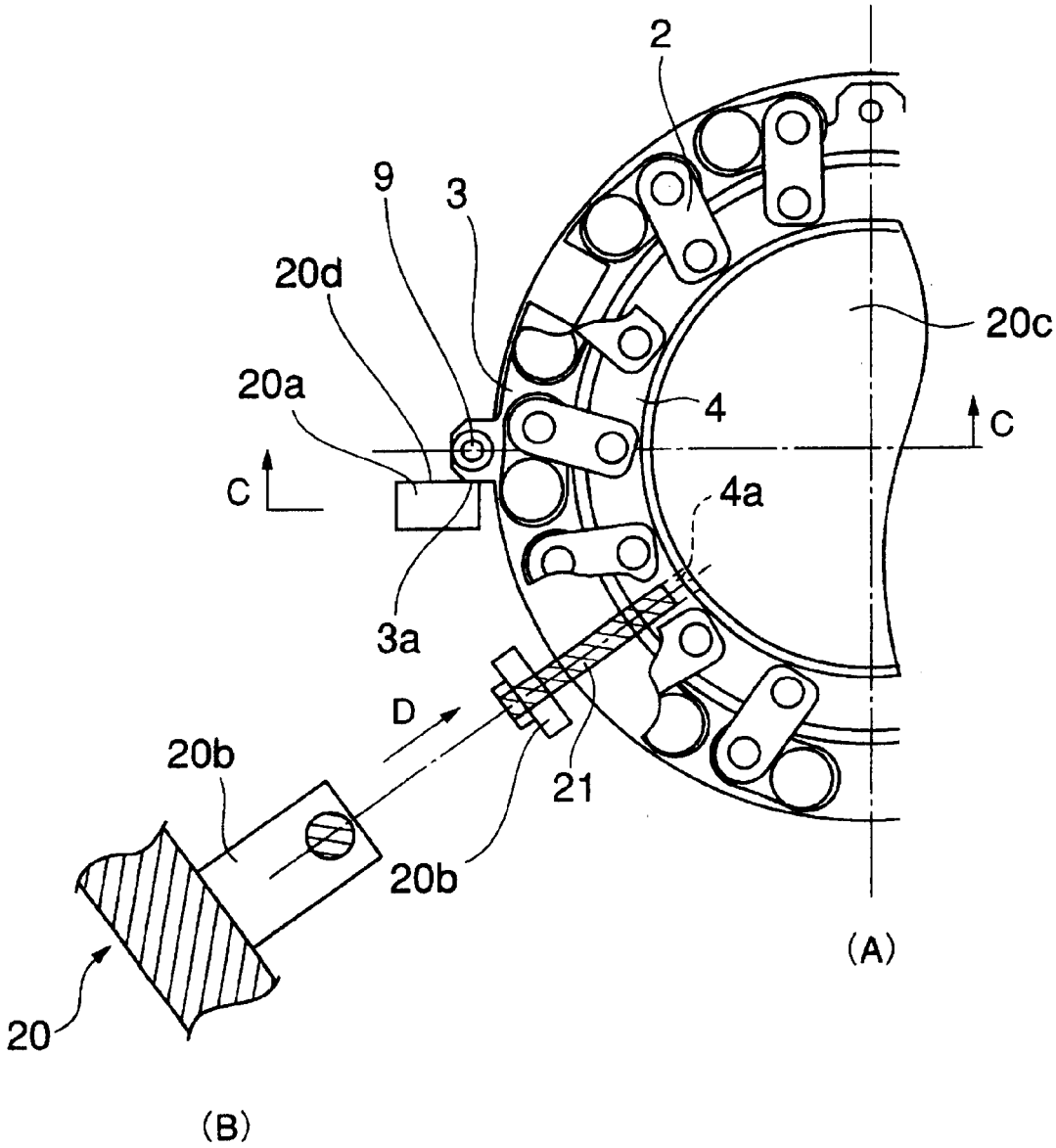
FIG. 4(A) and FIG. 4(B) represent the first example of the method of assembling and adjusting the adjustable nozzle mechanism.
Figure 5:
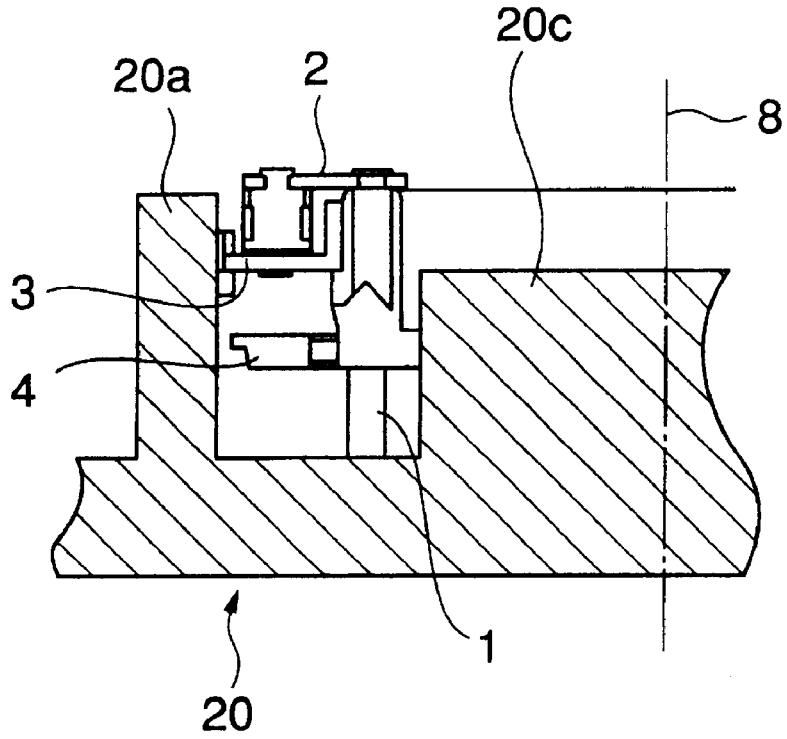
FIG. 5 is a view in the direction C of FIG. 4(A).

FIG. 4 and FIG. 5 represent the first method. A radial matching hole 4*a* is drilled in the nozzle mount 4 at the position apart from the center of the connection pin 9 which is to connect the drive lever 41 (see FIG. 8) by an angle A as shown in FIG. 3.

The position of the ring assembly 10 relative to the matching hole 4*a* of the nozzle mount 4 is determined by use of a jig (A) 20 of which the central angle between the contact face 20*d* of the contact part 20*a* and the center of the angle locating part 20*b* is pre-determined and a rod like jig (B), through inserting the end part of the jig (B) inserted in the angle locating part 20*b* of the jig (A) into the matching hole 4*a* and allowing the side face 3*a* of the connection part 03 of the link plate 3 to contact with the contact face 20*d* of the jig (A).

In this condition, the nozzle pins 6 which is integral with the nozzle vanes and supported free of rotation in the nozzle mount 4 are fixed to the lever plates 2 by staking in the holes at the lower end part of the lever plates 2 which constitute the connection parts of the ring assembly 10. A staking portion is indicated in FIG. 1 by reference number 2*a*.

Next, the second method is represented in FIG. 6, in which a radial matching hole 4*a* is drilled in the nozzle mount 4 at the position apart from the center of the connection pin 9 by an angle A the same as the case of the first method.

The position of the ring assembly 10 relative to the matching hole 4*a* of the nozzle mount 4 is determined by use of a jig (C) 22 of which the arm 22*a* is provided with a hole F. 22*c* into which said jig (B) inserted at an end part thereof and a groove 22*b* is formed into which the head part of the link pin 9 of the link plate 3 (or the connection part 03 shown in FIG. 3) can be inserted and the center angle between the hole 22*c* and the groove 22*b* is pre-determined to be A, by inserting the end part of the jig (B) inserted into the hole 22*c* of the jig (C) 22 into the matching hole 4*a* of the nozzle mount 4 and fitting the groove 22*b* to the head part of the connection pin 9 (or the connection part 03 shown in FIG. 3).

With this condition, the nozzle pins 9 integral with the nozzle vanes 1 are fixed to the lever plate by staking in the hole at the lower end part of the lever plate 2 of the ring assembly 10 (2*a* in FIG. 1 indicates a staking portion).

The perfect closing position of all the nozzle vanes 1 are thus determined in the ring assembly 10.

The adjustment of perfect closing position after the adjustable nozzle mechanism 100 adjusted as described above is installed into a variable capacity turbine, can be done as follows: the nozzle vanes 1 bound with the belt 11 (binding member) to keep the temporarily fixed state are released from the bound state, and the position of the set of the nozzle vanes is adjusted by the adjusting screw 44*a*and the locking nut 44*b* of a shutdown side stopper 44 which is provided for limiting the shift of the drive lever 41 connecting the ring assembly 10 to the actuator rod 40 as shown in FIG. 8. This adjustment can be done in the state the variable capacity turbine is assembled.

Therefore, the stopper mechanism provided for setting perfect closing position in the prior art nozzle assembly is unnecessary and omitted, variations in dimension of the nozzle vanes 1 and the ring assembly can be absorbed, assembling of the nozzle assembly including nozzle vanes 1 is simplified, and the setting of various specification of the adjustable nozzle mechanism is possible with the same nozzle assembly.

Reference number 43 is a maximum stopper, the adjustment of the full open position can be done by an adjusting screw 43*a* and a lock nut 43*b* of the maximum stopper 43 in the state the adjustable capacity turbine is assembled.

According to the embodiment, a plurality of the nozzle vanes 1 are bound temporarily by encircling them with a belt 11 (binding member) capable of easy binding/releasing to fix them in a perfect closed state with each vane contacting to each other, then the positioning of the nozzle vane 1 side (nozzle assembly) relative to the ring assembly (annular link mechanism) 10 side is done by the first or second method using the jig (A) and (B), or (B) and (C), and each of the nozzle pins which are fixed to the nozzle vanes to be integral with the vanes is fixed to each lever plate 2 constituting the connection part of the ring assembly by staking, so the adjustment of perfect closing position of the vanes in nozzle assembling process is unnecessary and the adjustment of perfect closing position can be done freely by the minimum stopper 44 in the state the variable capacity turbine is assembled.

As the adjustable nozzle mechanism 100 is set by this simple method in which a plurality of the nozzle vanes 1 are bound by an encircling band 11 (binding member), the relative position of the nozzle assembly to the ring assembly is determined by use of jigs, and each nozzle vane is fixed to each lever plate, and which eliminates the necessity of adjustment of perfect closing position in nozzle assembling process, the assembling and adjustment procedure is extremely simplified resulting in reduction of man-hours for assembling and adjustment, accordingly manufacturing cost is reduced compared with the prior art according to Japanese Patent No. 3085210 in which the adjustment of perfect closing position is done by use of a plurality of long slots in the link plate, stopper pins and jigs in nozzle assembling process.

According to the embodiment, a plurality of the nozzle vanes 1 are bound by encircling them with the belt 11 to determine perfect closing position, each nozzle vane is fixed to the lever plate 2, and the adjustment of perfect closing position is done as a whole by the minimum stopper 44 in the assembled state of the variable capacity turbine, so errors in dimensions of the nozzle assembly including nozzle vanes 2 and the ring assembly in their assembled states can be absorbed. Therefore, the perfect closing position of each nozzle vane is not determined uniquely according to the accuracy of the constituent parts and the setting of perfect closing position is possible with good accuracy without influenced by the accuracy in dimensions of the nozzle assembly and ring assembly, contrary to the case of Japanese Patent No. 3085210 in which variations occur in setting perfect closing position resulting in setting errors due to the adjustment done in nozzle assembling process by use of a plurality of log slots in the link plate, stopper pins, and jigs. Accordingly, setting of the adjustable nozzle mechanism 100 for various specifications is possible together with the setting with good accuracy.

It is also possible that the variable capacity turbine has the same function as the exhaust brake of truck and so forth by adjusting the perfect closing position by the minimum stopper 44.

As the adjustable nozzle mechanism assembly 100 can be transferred and assembled into the turbine in the state in which a plurality of the nozzle vanes 1 are encircled and bound with the belt 11 and fixed to the supporting parts of the nozzle mount 4, damage to the constituent parts of the nozzle assembly due to vibration or impact is prevented.

As described hitherto, according to the present invention, a plurality of nozzle vanes are encircled with a binding member capable of binding/releasing to temporarily fix the vanes in a state the vanes are perfectly closed with the vanes contacting to each other; then the positioning of the nozzle vane side, i.e. the nozzle assembly side relative to the annular link mechanism side, is performed by use of jigs in the temporarily fixed state; and the driving part of each nozzle vane is fixed to each connection part of the annular link mechanism; so the adjustment of perfect closing position is unnecessary in nozzle assembling process, and the adjustment of perfect closing position is possible in the assembled state of the variable capacity turbine.

As the adjustable nozzle mechanism is set by this simple method in which a plurality of the nozzle vanes are bound by an encircling binding member, the relative position of the nozzle assembly to the annular link mechanism is determined by use of jigs, and each nozzle vane is fixed to each lever plate, and which eliminates the necessity of adjustment of perfect closing position in nozzle assembling process, the assembling and adjustment procedure is extremely simplified resulting in reduction of man-hours for assembling and adjustment, accordingly manufacturing cost reduces.

As a plurality of nozzle vanes are bound by encircling them with a binding member to determine perfect closing position, each nozzle vane is fixed to the lever plate 2, and the adjustment of perfect closing position is done as a whole by a minimum stopper in the assembled state of the variable capacity turbine, errors in dimensions of the nozzle assembly including nozzle vanes and the ring assembly including the link plate and link parts in their assembled states can be absorbed. Therefore, the setting of the adjustable nozzle mechanism is possible with good accuracy without influenced by the accuracy in dimensions of the nozzle assembly and ring assembly, and also the adjustable nozzle mechanism is adaptable to various specifications.

It is also possible that the variable capacity turbine has the same function as the exhaust brake of truck and so forth by adjusting perfect closing position by the minimum stopper. The adjustment of the full open position of the nozzle vanes is possible by the maximum stopper in the assembled state of the variable capacity turbine.

As the adjustable nozzle mechanism assembly can be transferred and installed into the turbine in the state in which a plurality of the nozzle vanes are temporarily encircled and bound with the binding member and fixed to the supporting parts of the nozzle mount 4, damage to the constituent parts of the nozzle assembly due to vibration or impact is prevented.

What is claimed is:

1. A method of assembling and adjusting a variable capacity turbine having a plurality of nozzle vanes disposed along the circumferential direction of a turbine rotor in the inner radius side of the spiral scroll formed in the turbine casing and supported free of rotation on the supporting part of the nozzle mount, the turbine rotor being supported in the turbine casing for rotation around the rotation axis; and an annular link mechanism mounted free of rotation with respect to the rotation axis, provided with connection parts each of which is connected with the driving part of each of said nozzle vanes, and connected with the output end of an actuator; wherein said plurality of the nozzle vanes are temporarily encircled and bound with a binding member capable of binding/releasing in a state the vanes are perfectly closed with the vanes contacting to each other, then the driving part of each nozzle vane is fixed to the connection parts of the annular link mechanism with the vanes in the temporally bound state.

2. A method of assembling and adjusting a variable capacity turbine according to claim 1, wherein nozzle pins each of which is fixed to each of the nozzle vanes and supported in said nozzle mount free of rotation are fixed to lever plates constituting the connection parts of the annular link mechanism by means of staking or the like, in the temporarily bound state with the vanes perfectly closed.

3. A method of assembling and adjusting a variable capacity turbine according to claim 1, wherein the constituent parts can be transferred or installed into the turbine in the state of a nozzle assembly temporarily fixed to the supporting part of said nozzle mount by encircling and binding with a binding member capable of binding/releasing in a state the vanes are perfectly closed with the vanes contacting to each other.

4. A method of assembling and adjusting a variable capacity turbine according to claim 1, wherein a nozzle vane side mating part is provided in the nozzle mount, a link side mating part is provided in the annular link mechanism, a jig is prepared of which at an end side is formed a portion for determining the nozzle vane side position and an the other end side is formed a portion for determining the annular link mechanism side position, said portion for determining the nozzle vane side position of said jig is mated with said nozzle vane side mating part of said nozzle mount and said link side mating part is mated with said portion for determining the annular link mechanism side position with each nozzle vane temporarily fixed in perfect closing position, and the perfect closing position of the nozzle vane side and the annular link mechanism side is set up by way of the nozzle vane combining part of said nozzle mount by fixing said nozzle pins to said lever plate by staking.

5. A method of assembling and adjusting a variable capacity turbine according to claim 4, wherein said nozzle mount is provided with a mating hole as said nozzle vane side mating part, said jig is provided with a pin-like protrusion as said portion for determining the nozzle vane side position and a contact face capable of contacting with a face of the link plate constituting said annular link mechanism as said portion for determining the annular link mechanism side position, and positioning is done by allowing said face of the link plate to contact with said contact face of said jig in the state said protrusion of said jig is inserted in said mating hole of said nozzle mount.

6. A method of assembling and adjusting a variable capacity turbine according to claim 4, wherein said nozzle mount is provided with a mating hole as said nozzle vane side mating part, said jig is provided with a pin-like protrusion as said portion for determining the nozzle vane side position and a groove capable of meshing with the connection pin of the link plate constituting said annular link mechanism as said portion for determining the annular link mechanism side position, and positioning is done by allowing the connection part including connection pin of said link plate to mesh with said groove of said jig in the state said protrusion of said jig is inserted in said mating hole of said nozzle mount.

7. A device for assembling and adjusting a variable capacity turbine having a plurality of nozzle vanes disposed along the circumferential direction of a turbine rotor in the inner radius side of the spiral scroll formed in the turbine casing and supported free of rotation on the supporting part of the nozzle mount, the turbine rotor being supported in the turbine casing for rotation around the rotation axis; and an annular link mechanism mounted free of rotation with respect to the rotation axis, provided with connection parts each of which is connected with the driving part of each of said nozzle vanes, and connected with the output end of an actuator; wherein a binding member is provided which encircles and binds said plurality of the nozzle vanes to fix them in perfect closing position with the vanes contacting to each other, said binding member being capable of binding/releasing, and a minimum stopper is provided for limiting the shift of the linkage connecting said actuator and annular link mechanism toward perfect closing side.

8. A device for assembling and adjusting a variable capacity turbine according to claim 7, wherein a maximum stopper is provided for limiting the shift of the linkage toward full open side.

* * * * *